US006843907B1

(12) United States Patent
Kanazirev et al.

(10) Patent No.: US 6,843,907 B1
(45) Date of Patent: Jan. 18, 2005

(54) PROCESS FOR REMOVAL OF CARBONYL SULFIDE FROM HYDROCARBONS

(75) Inventors: Vladislav I. Kanazirev, Arlington Heights, IL (US); Thomas J. Dangieri, Algonquin, IL (US); Jayant K. Gorawara, Buffalo Grove, IL (US)

(73) Assignee: UOP LLC, Des Plaines, IL (US)

( * ) Notice: Subject to any disclaimer, the term of this patent is extended or adjusted under 35 U.S.C. 154(b) by 405 days.

(21) Appl. No.: 10/164,655

(22) Filed: Jun. 6, 2002

(51) Int. Cl.[7] ..... C10G 25/05; C10G 25/12; C07C 7/12

(52) U.S. Cl. ..... 208/213; 208/208 R; 585/820; 585/823; 585/825; 585/826

(58) Field of Search ..... 208/208 R, 213; 585/820, 823, 825, 826

(56) References Cited

U.S. PATENT DOCUMENTS

| | | | | | |
|---|---|---|---|---|---|
| 3,265,757 | A | | 8/1966 | Frevel et al. | 260/677 |
| 3,315,003 | A | | 4/1967 | Khelghatian | 260/677 |
| 4,455,446 | A | | 6/1984 | Brownell et al. | 585/850 |
| 4,830,734 | A | * | 5/1989 | Nagji et al. | 208/208 R |
| 4,835,338 | A | | 5/1989 | Liu | 585/823 |
| 5,271,835 | A | * | 12/1993 | Gorawara et al. | 208/228 |
| 6,531,103 | B1 | * | 3/2003 | Hakka et al. | 423/242.2 |

* cited by examiner

*Primary Examiner*—Walter D. Griffin
*Assistant Examiner*—Tam Nguyen
(74) *Attorney, Agent, or Firm*—John G. Tolomei; Frank S. Molinaro; Mark Goldberg

(57) ABSTRACT

The invention comprises a process for removal of carbonyl sulfide from a hydrocarbon, which comprises contacting a hydrocarbon stream containing carbonyl sulfide with an adsorbent and then regenerating the adsorbent by passing a heated gas, containing a hydrolyzing agent. The adsorbent that is regenerated by using this process retains at least 70% of its capacity for adsorption of sulfur as compared to fresh adsorbent.

17 Claims, No Drawings

PROCESS FOR REMOVAL OF CARBONYL SULFIDE FROM HYDROCARBONS

BACKGROUND OF THE INVENTION

This invention relates to the removal of carbonyl sulfide (COS) from a hydrocarbon stream by selective adsorption of the COS on an adsorbent and the complete regeneration of that adsorbent by the use of a moisture-containing gas.

DESCRIPTION OF THE RELATED ART

COS is an undesirable impurity in materials such as petroleum hydrocarbons because the COS is a sulfur source and therefore a potential atmospheric pollutant. COS also acts as an undesirable contaminant of industrial processes by poisoning polymerization catalysts when present in petroleum-derived polymerizable olefins such as propylene. COS may be present in such processes as a contaminant initially present in the feedstock or it may be formed in a treating process such as being the result of the molecular sieve-catalyzed reaction of carbon dioxide with hydrogen sulfide or other sulfur compounds.

Depending upon the process and the required purity of the product, the COS level in the starting material may be required to be reduced to below 1 part per million by weight (ppmw) and sometimes to levels as low as below 10 parts per billion weight (ppbw) in certain polymerization processes. Olefin polymerization processes often use high performing catalysts that are quickly poisoned by trace sulfur compounds and especially by COS. The prior art methods of removing COS can be divided into three categories: distillation, hydrolysis and the use of adsorbents. Each of these methods has certain disadvantages.

U.S. Pat. No. 3,315,003 (Khelghatian) discloses a process for removing COS from a hydrocarbon by first contacting the hydrocarbon with a liquid such as monoethanolamine which scrubs the hydrocarbon to remove acid gases such as $H_2S$ and $CO_2$ and part of the COS. The hydrocarbon is then distilled. After several subsequent distillations, the liquid bottom product is treated with a soda-lime to remove any remaining COS. However, distillation processes are extremely inefficient due to the cost of energy to vaporize virtually all of the liquid. It is, therefore, desirable to provide other means for the removal of COS impurities from organic liquids.

It has also been proposed to remove COS from hydrocarbons by catalytic hydrolysis to form $H_2S$, for example, using alumina as a catalyst. U.S. Pat. No. 3,265,757 teaches the hydrolysis of COS contained in a liquid hydrocarbon by contacting a mixture of the liquid hydrocarbon and water, at a temperature of from 20° to 50° C., with a high surface area alkali-impregnated, active alumina containing from 0.15 to 3 wt-% of sodium or potassium. The patentees state that the hydrolysis reaction will not commence, however, if the alumina is bone dry. They suggest either moistening the alumina catalyst with ion-free water prior to the reaction or passing a mixture of ion-free water and the liquid hydrocarbon through the catalyst bed until a sufficient amount of water has built up on the alumina to permit the hydrolysis reaction to proceed. However, while this process does remove COS (by converting it to $H_2S$), it does not remove sulfur per se from the hydrocarbon, but merely changes the form of the sulfur compound which still must be subsequently removed from the hydrocarbon by another process step.

U.S. Pat. No. 4,455,446 (Brownell et al) teaches the removal of COS from propylene by hydrolysis over a catalyst comprising platinum sulfide on alumina The patentees state that the hydrolysis reaction may be carried out in either the gaseous or liquid phase with a temperature of 35° to 65° C. used for the liquid phase. An amount of water at least double the stoichiometric amount of the COS to be hydrolyzed must also be present.

The disadvantage to these prior art hydrolysis methods of removing COS is the requirement that the stream be preconditioned with water and that there be a subsequent treatment to remove both the hydrolysis products and the water. In addition, the residual COS content in the effluent may still be too high, especially in view of the requirements of the particular polymerization process downstream.

It was then considered highly desirable to provide a process for the removal of sulfurous impurities such as COS from liquid hydrocarbons, preferably in the absence of water, using an adsorbent having high adsorption characteristics yet capable of being regenerated without substantial loss of adsorption capability. One such adsorbent is described in U.S. Pat. No. 4,835,338 in which an activated alumina adsorbent is used to remove the COS from a liquid propylene stream. In this process, the regeneration is carried out by passing a heated gas through the adsorbent. The disadvantage of this process is that after a few cycles, typically four to six regeneration cycles, the adsorbent COS capacity decreases in each successive cycle until it stabilizes at a level of about 40% of fresh equilibrium capacity. This low level of regeneration of the adsorbent means that a significantly higher quantity of adsorbent is required in order to achieve the desired removal of COS than would be necessary if complete regeneration of the adsorbent bed was achieved after each cycle. One way to substantially increase adsorption levels after regeneration is by using much higher regeneration temperatures than those described in U.S. Pat. No. 4,835,338.

A simpler method of achieving complete or nearly complete regeneration of the adsorbent is highly desirable. The economic attractiveness, or sometimes even the viability, of many adsorptive industrial chemical and petroleum refining processes depends greatly on the existence of a practical adsorbent regeneration process. Regenerative techniques are desirable because expenses associated with exchanging a spent adsorbent for a new charge, particularly when several thousands of pounds of material are involved, often far outweigh those associated with regeneration. The basic methods of regenerating an adsorbent are by either a significant reduction in pressure or a significant increase in temperature or both. This change in conditions(s) changes the adsorption equilibrium of the adsorbed compounds, thereby causing the release of a significant percentage of these compounds. In general, then, the major objective of regeneration processes is to prolong the useful life of an adsorbent through restoration of its activity. The steps to achieve such performance revival vary significantly and are usually developed only through careful research and experimentation.

Accordingly, it is an object of the present invention to provide a process for removal of COS with an adsorbent that is capable of complete regeneration at normal regeneration temperatures.

It is further an object of this invention that the process for removal of COS is applicable to alkali impregnated aluminas, zeolites and combinations thereof as well as other adsorbents that are capable of adsorbing COS.

SUMMARY OF THE INVENTION

The present invention comprises an improved process for removal of COS from a hydrocarbon stream which comprises contacting a hydrocarbon containing COS with an adsorbent and then regenerating the adsorbent by passing a heated gas through the adsorbent to remove at least 70 wt-% of sulfur adsorbed thereon, wherein a first portion of said heated gas contains between about 20 to 6000 mole parts per million (ppm) of a hydrolyzing agent and a second portion of said heated gas that contains less than 20 ppm of a hydrolyzing agent. The adsorbent that is regenerated by using this process retains at least 70% of its fresh equilibrium capacity for adsorption of sulfur, including COS, and preferably retains at least 90% of its fresh equilibrium capacity for adsorption of sulfur, including COS. Fresh equilibrium capacity is the equilibrium capacity of the adsorbent as measured in the first cycle of use.

DETAILED DESCRIPTION OF THE INVENTION

This invention comprises an improved process for removal of COS from hydrocarbons by adsorption on an adsorbent and then regeneration of the adsorbent when the capacity for adsorption of COS has been reached. The complete or nearly complete regeneration of the adsorbent is achieved by flowing a heated gas containing between about 20 to 6000 ppm of a hydrolyzing agent through the adsorbent after the adsorbent has been used to adsorb COS thereon from a hydrocarbon stream. After the hydrolyzing-containing gas is used, a dry gas containing less than 20 ppm (m) of the hydrolyzing agent may be passed through the adsorbent to remove the remaining adsorbed species and complete the typical regeneration process. In most cases, water is the hydrolyzing agent that is used, but other hydrolyzing agents, such as alcohols, including methanol and ethanol, may be used. Literally, hydrolysis is defined as "destruction, decomposition or alteration of a chemical substance by water" (*Encyclopedia of Science & Technology*, 6th Edition, McGraw-Hill Book Company, 1987). In a broader sense, the term hydrolysis "is given to a number of different chemical reactions, all of which consist in the addition of water to a complex and the subsequent resolution of the product into simpler substances" (*Thore's Dictionary of Applied Chemistry*, Longmans, Green and Co., 1943). Herein we use the term "hydrolysis" to designate the effect of water during the regeneration of adsorbents which have been used for the cyclic process of COS removal from hydrocarbons.

Although it is customary in the industry to refer to the process of removal of COS from organic liquids to be adsorption, when the process is analyzed, it is found to be a strong chemisorption process. The COS may bind to discrete sites on the adsorbent, in the form of stable species such as hydrogen thiocarbonate and thiocarbonate. The process of the present invention may be employed to remove COS from a range of hydrocarbons, including $C_1$ to $C_5$ hydrocarbons, including natural gas, LPG and propylene.

The adsorbent used in the process of the invention may comprise an alkali impregnated alumina, zeolite or mixture thereof, provided that the adsorbent has the capacity for adsorption of sulfur and sulfur compounds such as COS. Other adsorbents known to those skilled in the art may also be employed, such as alumina-zeolite composite adsorbents. More specifically, sodium doped aluminas that are useful in the present invention comprise from 3.5 to 6 mass % sodium as calculated as sodium oxide. The alumina-zeolite composites contain from about 20 to 50% X or Y-type zeolite. A useful composite alumina-zeolite adsorbent is doped with a metal component that is an alkali metal, an alkaline earth metal or a mixture thereof.

The adsorption process may be carried out at ambient temperature, although temperatures ranging from about 15° to about 100° C. may be used. If the hydrocarbon is at a temperature in this range after previous processing, it need not be heated or cooled prior to passing through the adsorbent.

The adsorption may be advantageously carried out in a packed column, although any other convenient form of maintaining contact between the adsorbent and the hydrocarbon may be employed, such as a slurry process. The flow rate of the hydrocarbon through the adsorbent should be sufficiently slow to permit a sufficient contact time to permit the desired adsorption of the COS in the hydrocarbon onto the adsorbent to occur. The actual amount of contact time will vary with the particle size and type of adsorbent.

The adsorption capacity of the adsorbent is determined by monitoring the sulfur content of the effluent from the adsorbent. Prior to reaching its adsorption capacity, the effluent will contain less than about 1 ppm sulfur. The effluent's carbonyl sulfide profile will consist of a zone of essentially no COS followed by a transient zone, where the COS concentration in the effluent slowly increases to close to the feed COS concentration. The transient zone is typically referred to as the mass transfer zone and is a function of flow rate, adsorbent particle size and process conditions. The total amount of sulfur, including COS, retained on the adsorbent in the steady state zone is defined as equilibrium capacity and can be easily calculated by one skilled in the art.

After the monitoring indicates that the capacity of the adsorbent has been reached, due to a rise in the sulfur content of the effluent, the adsorbent may be regenerated by passing a heated gas such as, hydrocarbon gases or vapors, nitrogen or other inert gases carrying a hydrolyzing agent in accordance with the present invention through the adsorbent. The heated gas contains from about 20 to 6000 ppm of a hydrolyzing agent, preferably from about 500 to 3000 ppm and most preferably 800 to 1200 ppm of the hydrolyzing agent. If the concentration of the hydrolyzing agent is in the lower part of the range, then a longer period of time will be necessary for the regeneration than when a higher concentration of the hydrolyzing agent is present. The heated gas is preferably heated to a temperature of from about 100° to 350° C., more preferably about 150° to 250° C., and most preferably about 230° C., and passed through the adsorbent at a rate of about 5 to about 30 moles per 100 gram adsorbent per hour until a very significant amount of the sulfur adsorbed thereon is removed. The term "a very significant amount" means about 70 wt-% or higher of the adsorbed sulfur and preferably 90 wt-% or higher. This level can be determined by analyzing the amount of residual sulfur in the adsorbent. Generally, the quantity of the hydrolyzing agent added throughout the regeneration depends on the residual sulfur on the spent adsorbent. As a rule of thumb, the spent adsorbent should be brought in contact with at least one mole hydrolyzing agent per each mole of residual sulfur during the regeneration process. A customary excess of hydrolyzing agent is recommended to make sure that most of the residual sulfur is removed. In addition, there is a certain flexibility how the hydrolyzing agent is added and used during the regeneration process. For example, one can add a given amount of hydrolyzing agent to the spent adsorbent and then heat up the adsorbent bed in order for the hydrolyzing process to occur during regeneration. The direction of flow of the regenerating gas through the adsorbent may be either in the sane direction as the hydrocarbon flow, e.g., when the adsorbent is packed in a column, or the regenerating gas may be passed through the adsorbent in a direction counter to the normal flow of hydrocarbon. Another way to introduce the hydrolyzing agent would be to direct or combine the regenerant effluent from an adsorbent dryer from another unit with the regenerant stream.

EXAMPLE 1

Ninety grams of an alkali impregnated alumina-zeolite composite adsorbent (sample A), was activated at 288° C. under vacuum and placed in a 1.3 cm ID tubular reactor to form a 105.4 cm bed. After activating the bed at 260° C. in $N_2$ at about 331 kPa pressure and 708 liters per hour feeding rate for about 6 hours, the adsorbent was cooled down to about 38° C. and the adsorption cycle was started. The adsorption cycle consisted of feeding through the bed a liquid propylene containing about 90 ppm COS at a rate of about 0.5 kg per hour and pressure of about 1910 kPa until sulfur breakthrough of the adsorbent bed occurs. The regeneration cycle was run at this point. The regeneration cycle was run for a sufficient period of time so that the sulfur concentration in the effluent flow was lower than 5 ppm (m).

Table 1 shows the data for the equilibrium capacity of three different adsorbents. The table also includes data published in U.S. Pat. No. 4,835,338. The amount of COS adsorbed in grams per hundred grams of adsorbent is shown as well as a percentage comparison of fresh adsorbent capacity on future cycles. This data clearly shows that with a variety of adsorbents the capacity of the adsorbent levels off at about 40% of the fresh equilibrium capacity after several cycles of regeneration. Table 1A summarizes the regeneration conditions of the adsorbents in Table 1. Selexsorb COS is an alumina adsorbent sold by Alcoa Inc., Houston, Tex. SG-731 adsorbent is a spherical alumina adsorbent, sold by UOP LLC of Des Plaines, Ill.

TABLE 1

| | Adsorbent COS Equilibrium Capacity | | | | | | | |
|---|---|---|---|---|---|---|---|---|
| | SG-731 | | Selex. COS | | Sample A | | '338 Patent | |
| Loading | g/ 100 g | % of fresh | g/ 100 g | % of fresh | g/ 100 g | % of fresh | g/ 100 g | % of fresh |
| Fresh | 2.53 | 100 | 2.41 | 100 | 1.19 | 100 | 1.95 | 100 |
| 1st Cycle | 1.68 | 66 | 1.85 | 77 | 0.88 | 74 | 0.95 | 49 |
| 2nd Cycle | 1.18 | 47 | 1.25 | 52 | 0.62 | 52 | 0.7 | 36 |
| 3rd Cycle | 1.02 | 40 | 1.02 | 42 | 0.65 | 55 | 0.6 | 31 |
| 4th Cycle | 0.93 | 37 | 0.94 | | | | | |

TABLE 1A

| | Regeneration conditions | | | | | |
|---|---|---|---|---|---|---|
| | SG-731 | | Selex. COS | | Sample A | |
| Cycle | Temp. ° C. | Duration, hours | Temp. ° C. | Duration hours | Temp. ° C. | Duration, hours |
| Fresh | | n/a | | n/a | | n/a |
| 1st Cycle | 260 | 8.2 | 260 | 6.4 | 260 | 5.9 |
| 2nd Cycle | 260 | 7.4 | 260 | 6.2 | 260 | 6.6 |
| 3rd Cycle | 260 | 8.2 | 260 | 6.2 | 260 | 16.3 |
| 4th Cycle | 260 | 7.6 | 260 | 8.2 | | |

EXAMPLE 2

A fresh portion of sample A catalyst was tested for adsorption as in Example 1 and then regenerated under various conditions in the same apparatus as in Example 1. The data in Table 2 shows that the initial COS adsorption capacity can be restored by temporary use of moist gas during the regeneration of the spent adsorbent followed by dry purge at the regeneration temperature. Regeneration temperatures of as low as 232° C. were tried in this experiment with very high levels of restoration of adsorption capacity. The water concentration appeared to be important to the amount of time necessary to regenerate the adsorbent. Although the moisture in the regeneration gas could not be measured directly in these experiments, the presence of water was indicated indirectly by the appearance of hydrogen sulfide in the reactor effluent. Assuming arbitrarily that at least 1 to 2 moles of water are needed for each mole $H_2S$ formed, the moisture levels between 20 and 70 ppm in the regenerating gas have been roughly estimated in this series of experiments. For example, when the moist gas had an estimated concentration of water of 70 ppm, the period of time for a complete regeneration was about 25 hours (see cycle seven in Table 2). This compared to the two-hour period that was necessary at a water concentration of 1100 ppm and 260° C. to regenerate the Sample A adsorbent completely. The elevated moisture levels in this case were achieved by injection of liquid water directly into the nitrogen stream used for regeneration. In addition, the water injection was followed by about 3.8 hours "dry" regeneration for a total duration of the regeneration process of 5.8 hours, as this is indicated in the data for the eleventh and twelfth cycles in Table 2.

TABLE 2

| | | COS Equilibrium Loading g/100 g | |
|---|---|---|---|
| Cycle | Regeneration Conditions | g/100 g | % of fresh |
| Fresh | 260° C. in laboratory | 1.19 | 100 |
| Second | 260° C., 5.9 hrs | 0.88 | 74 |
| Third | 260° C., 5.9 hrs | 0.62 | 52 |
| Fourth | 260° C., moisture present, 6.6 hours | 0.65 | 55 |
| Fifth | 260° C., moisture present, 16.3 hours | 0.88 | 74 |
| Sixth | 260° C., moisture present, 13.8 hours | 0.94 | 79 |
| Seventh | 260° C., moisture present, 25.0 hours | 1.25 | 105 |
| Eighth | 260° C., moisture present, 13.5 hours | 1.21 | 102 |
| Ninth | 260° C., moisture present, 15.2 hours | 1.17 | 98 |
| Tenth | 260° C., short water injection, 6.3 hours | 0.99 | 83 |
| Eleventh | 260° C., water injection to less than 5 ppm sulfur, then dry regeneration, total duration of 5.8 hours | 1.23 | 103 |
| Twelfth | 232° C., water injection to less than 5 ppm sulfur, then dry regeneration, total duration 5.8 hrs. | 1.23 | 103 |

EXAMPLE 3

Two runs were made with the SG-731 adsorbent according to the procedures used in Examples 1 and 2. The runs having an "A" in the cycle number were done without water addition, while the runs having a "B" in the cycle number had some moisture present (even if measurements were not read of the moisture content). Significantly more COS was adsorbed when there was residual moisture in the regeneration gas. The dry gas that followed the use of the moist gas removed any water adsorbed by the adsorbent as well as byproducts such as $H_2S$.

TABLE 3

| Cycle # | Temp, ° C. | Duration, hr | Residual Moisture? | Added Water | COS equilibrium loading g/100 g |
|---|---|---|---|---|---|
| 1A | 288 | Overnight | No | No | 2.53 |
| 1B | 288 | Overnight | No | No | 2.46 |
| 2A | 260 | 8.3 | No | No | 1.68 |
| 2B | 288 | 35 | Yes | No | 2.41 |
| 3A | 260 | 8.2 | No | No | 1.18 |
| 3B | 232 | 9.1 | Yes | No | 1.73 |
| 4A | 260 | 7.4 | No | No | 1.02 |
| 4B | 232 | 9.1 | Yes | No | 1.48 |

TABLE 3-continued

| Cycle # | Temp, ° C. | Duration, hr | Residual Moisture? | Added Water | COS equilibrium loading g/100 g |
|---|---|---|---|---|---|
| 5A | 260 | 8.2 | No | No | 0.93 |
| 5B | 232 | 6 | Yes | Yes | 1.84 |
| 6A | 260 | 7.6 | No | No | 0.83 |
| 6B | 232 | 5.5 | Yes | no | 1.57 |

EXAMPLE 4

Table 4 compares the sulfur content of selected spent adsorbent in the case of "dry" and "wet" regeneration. The spent adsorbent which has been subjected to "wet" regeneration prior discharge, has several times less sulfur compared to the same adsorbent subjected to "dry" regeneration. The residual S content was measured by a combustion method on the spent adsorbent samples after they have been discharged from the test reactor.

TABLE 4

| Adsorbent | Number of cycles | S Loading in the last cycle g/100 g | Regeneration mode | Residual S Content mass % |
|---|---|---|---|---|
| SG-731 | 12 | 0.81 | Dry | 1.71 |
| SG-731 | 6 | 1.57 | Wet | 0.156 |
| Selexsorb COS | 8 | 0.79 | Dry | 1.54 |
| Sample A | 12 | 1.23 | Wet | 0.224 |

What is claimed is:

1. A process for removal of carbonyl sulfide from a hydrocarbon stream wherein said process comprises:

a) contacting a hydrocarbon containing carbonyl sulfide with an adsorbent to adsorb the carbonyl sulfide until the adsorbent has reached its capacity for adsorbance of said carbonyl sulfide; and b) then regenerating the adsorbent by passing a heated gas through the adsorbent, wherein said heated gas contains between 20 and 6000 mole parts per million of a hydrolyzing agent to remove a very significant amount of the sulfur adsorbed thereon.

2. The process of claim 1 wherein after said heated gas passes through said adsorbent, a second volume of heated gas is passed through said adsorbent, wherein said second volume of heated gas comprises less than 20 mole parts per million of said hydrolyzing agent.

3. The process of claim 1 wherein said hydrolyzing agent is selected from the group consisting of water, methanol and ethanol.

4. The process of claim 1 wherein said heated gas contains between 800 and 1200 mole parts per million of said hydrolyzing agent.

5. The process of claim 1 wherein the adsorbent maintains at least 70% of its fresh equilibrium capacity for carbonyl sulfide after reaching an operating condition of stable regenerative performance.

6. The process of claim 1 wherein said adsorbent maintains at least 90% of its fresh equilibrium capacity for carbonyl sulfide after reaching an operating condition of stable regenerative performance.

7. The process of claim 1 wherein said adsorbent is selected from the group s consisting of alkali-impregnated aluminas, zeolites and combinations thereof.

8. The process of claim 7 wherein said alkali-impregnated aluminas contain from about 3.5 to 6 mass % sodium as calculated as sodium oxide.

9. The process of claim 7 wherein said adsorbent is an alumina zeolite composite comprising about 20 to 50% zeolite, wherein said zeolite is selected from the group consisting of X-type zeolites and Y-type zeolites.

10. The process of claim 7 wherein said adsorbent comprises an alumina component, a zeolite component and a metal component selected from the group consisting of an alkali metal, an alkaline earth metal and mixtures thereof.

11. The process of claim 1 wherein during said regeneration, said heated gas is at a temperature between about 100° and 350° C.

12. The process of claim 11 wherein said heated gas is at a temperature between 150° and 250° C.

13. The process of claim 1 wherein said heated gas is at a temperature of about 230° C.

14. The process of claim 1 wherein said adsorbent has a very significant amount of the sulfur removed during said process.

15. The process of claim 1 wherein the hydrolyzing agent is added to the heated gas prior to the passage of said heated gas through the adsorbent.

16. The process of claim 1 wherein the hydrolyzing agent is added to said adsorbent, then said adsorbent is heated and said heated gas passes through said adsorbent.

17. The process of claim 1 wherein said heated gas comprises a regenerant effluent from another adsorbent dryer.

* * * * *